United States Patent [19]

Llinares, Jr.

[11] Patent Number: 4,569,311

[45] Date of Patent: Feb. 11, 1986

[54] METHOD OF FIRING A PULVERIZED COAL-FIRED FURNACE

[75] Inventor: Vincent Llinares, Jr., Rockville, Conn.

[73] Assignee: Combustion Engineering, Inc., Windsor, Conn.

[21] Appl. No.: 305,060

[22] Filed: Sep. 24, 1981

[51] Int. Cl.[4] ..... F22B 37/42; F23D 1/00

[52] U.S. Cl. ..... 122/449; 110/347; 110/263

[58] Field of Search ..... 98/38 B, 40 N; 110/347, 110/263; 122/449, 479 B; 239/297

[56] References Cited

U.S. PATENT DOCUMENTS

| | | | |
|---|---|---|---|
| Re. 24,119 | 2/1956 | Armacost | 122/479 B |
| 1,608,833 | 11/1926 | Birkenmaier et al. | 239/297 |
| 1,627,117 | 5/1927 | Preble et al. | 239/297 |
| 1,752,922 | 4/1930 | Mueller | 239/297 |
| 2,363,875 | 11/1944 | Kreisinger et al. | 122/479 |
| 2,575,885 | 11/1951 | Mittendorf | 122/479 |
| 2,649,079 | 8/1953 | Van Brunt | 122/479 B |
| 2,740,670 | 4/1956 | Harder | 239/297 |
| 3,224,419 | 12/1965 | Lowenstein et al. | 110/347 |
| 4,064,295 | 12/1977 | Singer | 239/297 |
| 4,089,628 | 5/1978 | Blackburn | 110/347 |
| 4,304,196 | 12/1981 | Chadshay et al. | 110/347 |

FOREIGN PATENT DOCUMENTS

| | | | |
|---|---|---|---|
| 727237 | 4/1980 | U.S.S.R. | 239/297 |

*Primary Examiner*—Henry C. Yuen

*Attorney, Agent, or Firm*—William W. Habelt

[57] ABSTRACT

A pulverized coal-air stream or auxiliary air stream discharging into a furnace (1) from a delivery pipe (12) is deflected away from the longitudinal axis of the delivery pipe by directing a working fluid stream, preferably air or flue gas, against the coal-air or auxiliary air stream as it approaches the outlet of the delivery pipe so as to impinge thereagainst at an angle of substantially ninety degrees. The resulting angle of deflection of the coal-air or auxiliary air stream away from its longitudinal axis is controlled by varying the momentum of the working fluid stream impinged against it.

5 Claims, 5 Drawing Figures

METHOD OF FIRING A PULVERIZED COAL-FIRED FURNACE

BACKGROUND OF THE INVENTION

The present invention relates to pulverized coal-fired furnaces and, more particularly, to a method and apparatus for deflecting as it discharges from coal-air and auxiliary air nozzles into the furnace enclosure.

One method of firing coal in conventional coal-fired steam generator boilers is known as tangential firing. In this method, pulverized coal is introduced to the furnace in a primary air stream through nozzles, termed coal-air admission assemblies, disposed in windboxes located in corners of the furnace. Each windbox comprises a vertical array of alternate auxiliary air compartments and coal-air admission assemblies. The coal-air and auxiliary air streams discharged from these burners are aimed tangentially to an imaginary circle in the middle of the furnace to create a fireball therein extending over the height of the windbox.

A distinct advantage of the tangential firing concept is that a wide range control of steam temperature can be obtained by physically raising or lowering the fireball within the furnace. By physically raising the fireball within the furnace, the heat absorption by the furnace bounding walls, and therefore the heat lost by the combustion gases, is decreased such that the temperature of the combustion gases leaving the combustion zone and passing over the superheat and reheat convection surface located downstream of the furnace is increased thereby increasing the potential outlet steam temperature. Similarly, by physically lowering the fireball within the furnace, the heat absorption by the furnace bounding walls, and therefore the heat lost by the combustion gases, is increased such that the temperature of the combustion gases leaving the furnace and passing over the superheat and reheat convective surface located downstream of the furnace is decreased thereby decreasing the potential outlet steam temperature.

In the prior art, it is common to physically raise and lower the fireball within the furnace by tilting the nozzle tips of the coal-air admission assemblies and the auxiliary air compartments disposed in the corner windboxes upwardly or downwardly in response to steam temperature measurements see for example U.S. Pat. Nos. 2,363,875 and 2,575,885. Presently, the nozzles of the coal-air admission assemblies and the auxiliary air compartments are linked together by a mechanical linkage so as to tilt in unison either automatically in response to steam temperature by means of an actuator or by manual adjustment. However, the linkage mechanisms for accomplishing such tilting requires many moving parts.

More recently, as disclosed in U.S. Pat. No. 4,294,178, it has been found desirable to admit the coal-air streams and auxiliary air streams into the furnace at different firing angles for purposes of controlling the formation of nitrogen oxides, a noxious pollutant, and to control slagging of the bounding furnace walls. In particular, it has been found desirable to aim the coal-air streams into the furnace towards an imaginary circle near the center of the furnace and to aim the auxiliary air into the furnace along the bounding walls so as to form a central fireball wherein the coal is burned under substoichiometric conditions surrounded by a sheet of air along the bounding furnace walls. In present operation, this is accomplished by directing the coal-air streams into the furnace at a set angle and directing the auxiliary air streams into the furnace at varying angles through a nozzle tip which may be tilted in the horizontal direction as well as in the vertical direction as described above for steam temperature control. Necessarily, the mechanical linkage for tilting the auxiliary air nozzle tips is more extensive in order than the nozzle tip may be adjusted in a horizontal plane and simultaneously in a vertical plane.

In addition, when a particularly heavy slagging coal is fired, it is possible for the slag deposits to bridge between the nozzle and the bounding wall so as to lock the nozzle tip in a set position. When this occurs and the operator attempts to adjust the nozzle tilt in order to raise or lower the fireball within the furnace, the linkage mechanism associated with the locked nozzle tip or the nozzle tip itself may be damaged.

It is an object of the present invention to provide a method and apparatus for deflecting a coal-air stream discharging from a coal-air nozzle and an auxiliary air stream discharging from an auxiliary air nozzle in a vertical and/or horizontal direction without resort to such mechanical linkages and the many moving parts associated therewith.

SUMMARY OF THE INVENTION

In accordance with the invention, the angle of admission of a coal-air or auxiliary air stream from a delivery pipe on a pulverized coal-fired furnace can be varied vertically or horizontally by deflecting the coal-air and auxiliary air streams as they approach the exit of their delivery pipes by directing a working fluid stream against each of the coal-air and auxiliary air streams at an angle thereto of substantially ninety degrees as they are about to discharge into the furnace. The momentum of the high velocity fluid stream impinging against each of the coal-air and auxiliary air streams leaving the delivery pipes will cause the coal-air and auxiliary air streams to be deflected away from the longitudinal axis of the delivery pipes.

By directing a high velocity fluid stream downwardly against the coal-air and auxiliary air streams discharging from the delivery pipes, the coal-air and auxiliary air streams will be deflected at a downward angle into the furnace thereby lowering the position of the fireball therein. Similarly, by directing a high velocity fluid stream upwardly against the coal-air and auxiliary air streams discharging from the delivery pipes, the coal-air and auxiliary air streams will be directed upwardly into the furnace thereby raising the position of the fireball within the furnace. Additionally, by directing a high velocity fluid stream against the coal-air and auxiliary air streams from either side, the coal-air and auxiliary air streams discharging into the furnace will be directed away from the longitudinal axis of their respective delivery pipes in a horizontal plane thereby altering the fireball for the purposes of controlling the formation of nitrogen oxides and controlling the slagging of the furnace bounding walls. Further, one high velocity fluid stream could be directed against the coal-air and auxiliary air streams from above or below while a second high velocity fluid stream is directed against the coal-air and auxiliary air streams from either side so that the coal-air and auxiliary air streams discharging into the furnace might be simultaneously and selectively directed therein both vertically and horizontally.

The preferred apparatus for carrying out the method of the present invention comprises coal-air and auxiliary air admission assemblies comprised of delivery pipes each having an outwardly-flared nozzle portion at the discharge end thereof and a plurality of plenum chambers bounding portions of the delivery pipes. The plenum chambers open into the delivery pipes near the discharge end thereof at the beginning of the curvature of the flared nozzles through a series of holes or slots in the wall of a delivery pipes. Each opening through the wall of a delivery pipe is aligned transverse to the longitudinal axis of the delivery pipe.

The working fluid, preferably air or flue gas, is fed to the plenums from a supply source, such as a high pressure booster fan working in combination with the forced draft fan or a high pressure gas recirculation fan. The working fluid then passes through each opening connecting the plenums to the interior of the delivery pipes so as to impinge against the coal-air or auxiliary air streams passing therethrough at substantially a ninety degree angle thereby causing the coal-air or auxiliary air streams to be deflected away from the longitudinal axis of the delivery pipes as the coal-air or auxiliary air streams discharge into the furnace.

The degree of deflection of the coal-air or auxiliary air streams away from the longitudinal axis of the delivery pipes either vertically or horizontally may be controlled by controlling the amount of working fluid being supplied to the plenums. As the amount of working fluid is increased, both the mass flow rate and the velocity of the working fluid is increased thereby increasing the momentum of the fluid stream being impinged against the coal-air or auxiliary air streams. The coal-air or auxiliary air streams discharging from the delivery pipes may be selectively directed vertically or horizontally into the furnace so as to alter the fireball therein by controlling the amount of working fluid supplied to the upper and lower plenums associated with the delivery pipes in response to steam temperature, or nitrogen oxide pollution or furnace slagging conditions.

DESCRIPTION OF A PREFERRED EMBODIMENT

Figure 1:
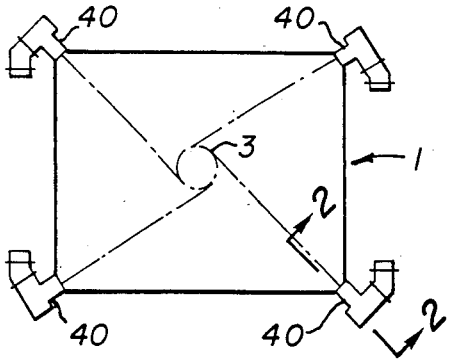
FIG. 1 is a diagrammatic plan view of a furnace employing the tangential firing method.

While the present invention may be applied, in spirit and in scope, to a number of different firing methods employed in conventional coal-fired steam generator boiler furnaces, such as single wall firing or opposed wall firing, it may be best described and understood when embodied in a pulverized coal-fired furnace employing the tangential firing method as illustrated in FIG. 1. In the tangential firing method, coal and air are introduced to the furnace through coal-air admission assemblies 10 and auxiliary air assemblies 20 mounted in the four corners of the furnace 1. The coal-air and auxiliary air admission assemblies 10 and 20 are orientated so as to deliver the pulverized coal and air streams tangentially to an imaginary circle 3 in the center of the furnace 1 so as to form a rotating vortex-like flame termed a fireball therein.

Figure 2:
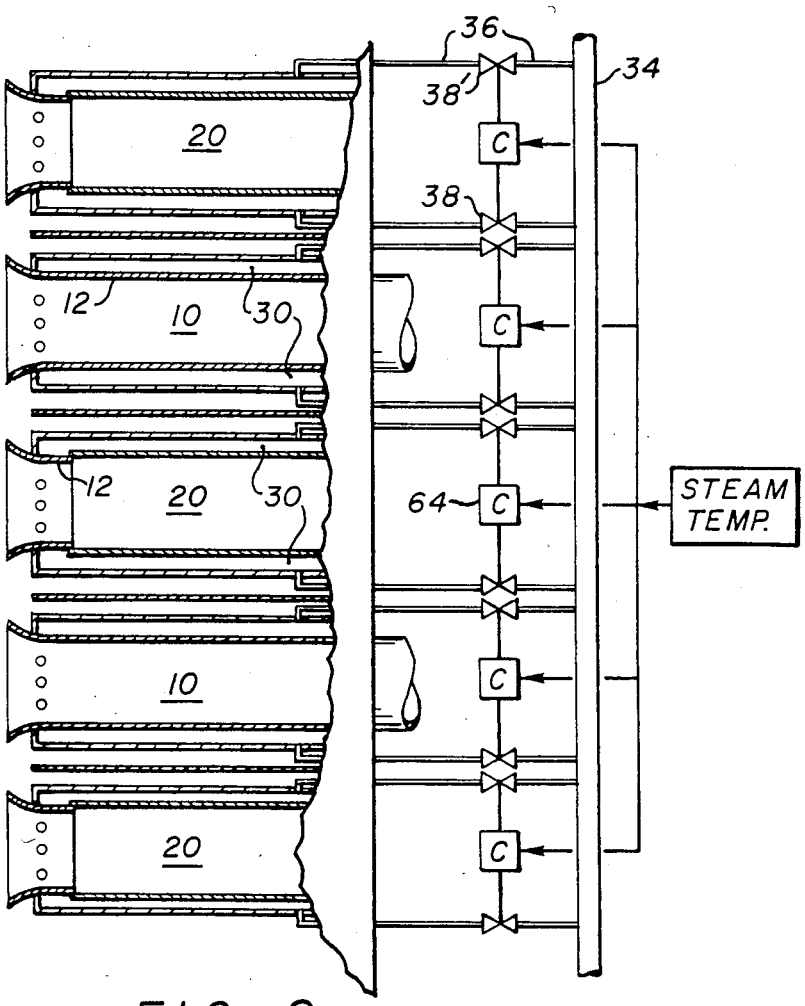
FIG. 2 is an elevational, cross-sectional view, taken along line 2—2 of FIG. 1, of a windbox having two coal-air admission assemblies arranged between three auxiliary air admission assemblies, the coal-air and auxiliary air admission assemblies designed in accordance with the present invention.
Figure 3:
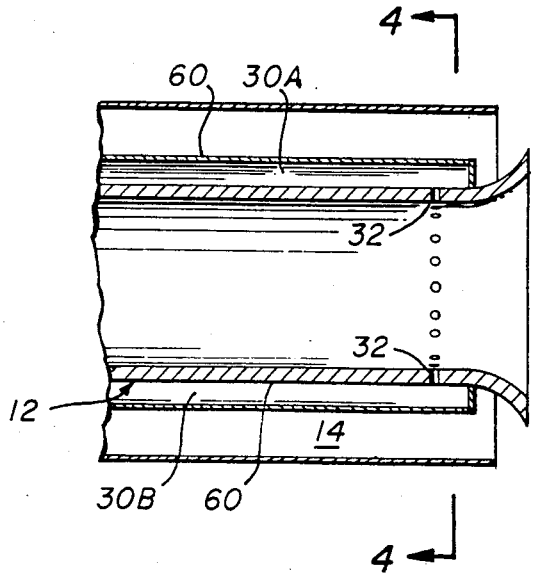
FIG. 3 is an elevational, cross-sectional view of a single coal-air and auxiliary air admission assembly designed in accordance with the present invention.

As shown in FIG. 2, a plurality of coal-air admission assemblies 10 are arranged in the corners in a vertical column separated by auxiliary air admission assemblies 20, through which additional air to support combustion of the coal is introduced to the furnace.

Each coal-air and auxiliary air admission assembly 10 and 20 comprises a delivery pipe 12 extending therethrough and opening into the furnace thereby providing a flowpath through which the coal-air and auxiliary air streams pass to the furnace. In accordance with the present invention, the coal-air and auxiliary air streams discharging from the delivery pipes into the furnace are deflected away from the longitudinal axis of the delivery pipes by impinging a high velocity working fluid against the pulverized coal-air streams and auxiliary air streams at substantially ninety degree angles thereto as the pulverized coal-air streams and auxiliary air streams are about to discharge into the furnace. The momentum of the high velocity working fluid which is directed transversely to the longitudinal axes of the delivery pipes would react with the momentum of the coal-air streams and auxiliary air streams which are travelling parallel to the longitudinal axis of the delivery pipes to yield a resultant momentum for each of the combined streams which would be directed at an angle away from the longitudinal axes of the delivery pipes.

If the working fluid is directed downwardly against the coal-air streams and auxiliary air streams discharging from delivery pipes 12, the coal-air streams and auxiliary air streams will be directed downwardly into the furnace. If the working fluid is directed upwardly against the coal-air streams and auxiliary air streams discharging from delivery pipes 12, the coal-air streams and auxiliary air streams will be directed upwardly into the furnace. Additionally, if the working fluid is directed against the coal-air streams and auxiliary air streams from the side, the coal-air streams and auxiliary air streams will be deflected away from the longitudinal axes of the delivery pipes 12 either towards the center of the furnace or towards the walls of the furnace as desired.

In accordance with the present invention, at least two plenum chambers 30 are disposed adjacent each delivery pipe 12, one along the upper portion thereof and one along the bottom portion thereof as illustrated in FIGS. 2, 3, 4A, and 4B. The plenum chambers are connected in fluid communication with the interior of the delivery pipe 12 by openings 32 in the wall of the delivery pipe near the discharge end thereof. The plenum chambers 30 are connected to a working fluid supply header 34 by means of supply lines 36. A control valve 38, 38′ is disposed in each supply line 36 to selectively vary the amount of working fluid passing therethrough from the supply header 34 to the plenum chambers 30.

The preferred working fluid in this application is a gas, such as air or flue gas. In many instances, it may be desirable to use air as the working fluid as the air impinged against the pulverized coal-primary air streams and the auxiliary air streams will mix therewith and subsequently support combustion of the coal in the furnace. However, in other instance it may be desirable to use flue gas as the working fluid for impinging against the pulverized coal-primary air stream discharging from the delivery pipe as the flue gas would mix therewith and result in a lower combustion temperature in the furnace thereby reducing the generation of oxides of nitrogen during the combustion process.

Figure 4A:
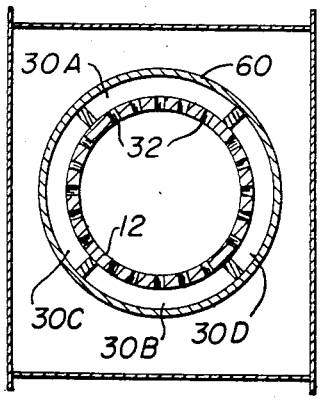
FIG. 4A shows a cross-sectional view taken along line 4—4 of FIG. 3 of a coal-air or auxiliary air admission assembly designed in accordance with the present invention with the opening between the plenums and the interior of the delivery pipe being a series of holes disposed at the inlet curvature of the flared nozzle.
Figure 4B:
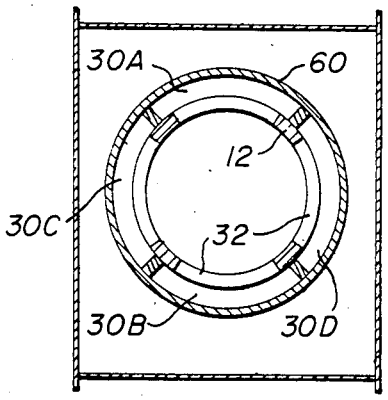
FIG. 4B is a cross-sectional view taken along line 4—4 of FIG. 3 of a coal-air or auxiliary air admission assembly designed in accordance with the present invention with the openings between the plenums and the interior of the delivery pipe comprising elongated, circumferential slots disposed at the inlet curvature of the flared nozzle.

Preferably, each delivery pipe 12 is entirely encased at least near the discharge end thereof by a second pipe 60 disposed coaxially about the delivery pipe so as to define therebetween an annular plenum chamber which is subdivided into at least four subchambers 30A, 30B, 30C, and 30D as illustrated in FIGS. 4A and 4B. Each of the plenum chambers are connected in fluid communication to the interior of the delivery pipe 12 by openings 32 which may be a series of holes drilled through the wall of the delivery pipe 12 near the discharge end thereof as shown in FIG. 4A or the openings 32 may take the form of circumferentially elongated slots in the wall of the delivery pipe 12 near the discharge end thereof as shown in FIG. 4B.

By selectively directing the working fluid through either plenum chamber 30A or 30B, the coal-air or auxiliary air stream passing through the delivery pipe 12 will be deflected either upwardly or downwardly as it enters the furnace. Similarly by directing the working fluid through either plenum chamber 30C or 30D, the coal-air stream or auxiliary air streams discharging from the delivery pipe 12 will be directed either towards the center of the furnace or along the furnace walls. Additionally, the working fluid may be directed simultaneously to one of chambers 30A or 30B and one of chambers 30C or 30D so that the coal-air stream or auxiliary air stream discharging from the delivery pipe 12 may be directed into the furnace simultaneously at both a horizontal angle and a vertical angle to the longitudinal axis of the delivery pipe 12.

Preferably, the working fluid would be automatically selectively directed to either the upper plenum chamber 30A or the lower plenum chamber 30B in response to steam temperature. When the steam temperature departs from a preselected value, the working fluid would be sent to either the upper plenum chamber 30A or the lower plenum chamber 30B. In response to a drop in steam temperature below the preselected value, a signal would be sent to controllers 64 to open the control valves 38 to allow a working fluid to pass through lines 36 to the lower plenum chambers 30B associated with the delivery pipes 12. The working fluid would then pass from the lower plenum chamber 30B through holes 32 to impinge on the pulverized coal-primary air streams and auxiliary air streams as they are about to discharge in the furnace from the delivery pipe 12 so as to deflect the coal-air streams and auxiliary air streams upwardly.

By adjusting the control valve 38, the amount of working fluid passing through the supply lines 36 to the plenum chamber 30 can be controlled thereby controlling the momentum of the stream of working fluid being impinged against the coal-air streams and auxiliary air streams so as to fine tune the angle of deflection upwardly from the longitudinal axes of the delivery pipes. In this manner, the fireball would be raised in the furnace thereby decreasing the amount of heat absorption by the furnace walls and raising the gas temperature passing over the downstream superheater and reheater surface thereby causing steam temperature to increase.

Similarly, when stream temperature rises above the preselected value, a signal will be sent to the controller 64 to open the control valves 38′ to allow working fluid to the upper plenum chambers 30A to impinge downwardly against the coal-air streams and auxiliary air streams discharging from the delivery pipes and, therefore, deflect the coal-air streams and auxiliary air streams downwardly as they enter the furnace. In this manner, the fireball would be lowered within the furnace thereby increasing heat absorption by the furnace walls and lowering the temperature of the gas passing over the downstream superheat and reheat surface and thereby decreasing steam temperature.

To deflect the coal-air streams and auxiliary air streams away from the longitudinal axis of the delivery pipe, the working fluid must impinge against the coal-air stream or auxiliary air stream with sufficient momentum to add a component of momentum to the air molecules or pulverized coal particles which is transverse to the longitudinal axis of the delivery pipe. If the working fluid is directed against the coal-air stream or auxiliary air stream at substantially a right angle thereto, the angle of deflection of the coal-air or auxiliary air stream away from the longitudinal axis of the delivery pipe will be equal to the arc tangent of the ratio of the momentum of the working fluid to the momentum of the coal-air stream or auxiliary air stream prior to impact.

Consider for example a typical pulverized coal-primary air stream having a density of 0.10 pounds per cubic foot passing at a flow rate of one hundred cubic feet per second through a coal delivery pipe having a cross-sectional area of one square foot. The momentum of such a coal-air streams and auxiliary air streams would be 1000 foot pounds per second squared. A stream of air at a temperature of 180 F., density of 0.0625 pounds per cubic foot, and flowing at a rate of thirty cubic feet per second out of the plenum chamber into the coal delivery pipe through a slot or series of holes having a total flow area of 0.1 square feet, would have a momentum of 563 foot pounds per second squared. By impinging this stream of working fluid against the longitudinally flowing coal-air stream at a ninety degree angle thereto, the coal-air stream would be deflected away from the longitudinal axis of the coal delivery pipe at an angle equal to the arc tangent of 563/1000, i.e., an angle of about 30 degrees.

Although described and illustrated hereinabove as embodied in a tangential firing system utilizing pulverized coal as a fuel, it is to be understood that the present invention applies, in scope and in spirit, to a number of different firing methods employed in conventional steam generating boiler furnaces, burning pulverized fuels admitted thereto entrained in a carrier gas.

I claim:

1. In a steam generator having a pulverized coal-fired furnace, a method of firing the furnace comprising:

a. introducing into the furnace a stream of pulverized coal entrained in primary air along a substantially horizontal longitudinal axis;

b. introducing into the furnace independently of said pulverized coal and primary air stream a stream of auxiliary air along an axis substantially parallel to said longitudinal axis; and c. impinging a first stream of working fluid against the pulverized coal and primary air stream at substantially ninety degrees thereto so as to deflect the pulverized coal and primary air stream away from said longitudinal axis as the pulverized coal and primary air is introduced into the furnace.

2. A method as recited in claim 1 further comprising impinging a second stream of working fluid against the auxiliary air stream at substantially ninety degrees thereto so as to deflect the auxiliary air stream away from said longitudinal axis as the auxiliary air stream is introduced into the furnace.

3. A method as recited in claim 2 further comprising varying the momentum of the working fluid stream impinging against the pulverized coal and primary air stream and of the working fluid stream impinging against the auxiliary air stream so as to selectively deflect the pulverized coal and primary air stream and the auxiliary stream into the furnace at a desired angle of deflection with respect to said longitudinal axis.

4. A method as recited in claim 1 or 2 further comprising selectively deflecting the pulverized coal and primary air stream away from said longitudinal axis in a vertical direction in response to steam temperature.

5. A method as recited in claim 3 further comprising selectively deflecting the auxiliary air stream away from said longitudinal axis in a vertical direction in response to steam temperature.

* * * * *